US005167487A

United States Patent [19]

Rock

[11] Patent Number: 5,167,487

[45] Date of Patent: Dec. 1, 1992

[54] COOLED SHROUD SUPPORT

[75] Inventor: Peter J. Rock, Byfield, Mass.

[73] Assignee: General Electric Company, Cincinnati, Ohio

[21] Appl. No.: 666,959

[22] Filed: Mar. 11, 1991

[51] Int. Cl.[5] ..... F04D 29/18

[52] U.S. Cl. ..... 415/173.3; 415/173.1; 415/175; 415/177; 415/178

[58] Field of Search ..... 415/173.1, 173.2, 173.3, 415/174.2, 175, 177, 178; 60/39.75

[56] References Cited

U.S. PATENT DOCUMENTS

| | | | |
|---|---|---|---|
| 2,402,841 | 6/1946 | Ray | 415/175 |
| 2,940,660 | 6/1960 | Caddell | 415/175 |
| 3,583,824 | 6/1971 | Smuland et al. | 415/117 |
| 3,807,891 | 4/1974 | McDow et al. | 415/116 |
| 4,127,357 | 11/1978 | Patterson | 415/116 |
| 4,303,371 | 12/1981 | Eckert | 415/175 |
| 4,497,610 | 2/1985 | Richardson et al. | 415/175 |
| 4,553,901 | 11/1985 | Laurello | 415/138 |
| 4,573,865 | 3/1986 | Hsia et al. | 415/173.1 |
| 4,573,866 | 3/1986 | Sandy et al. | 415/173.1 |
| 4,676,715 | 6/1987 | Imbault et al. | 415/116 |
| 4,759,687 | 7/1988 | Miraucourt et al. | 415/127 |
| 4,863,345 | 9/1989 | Thompson et al. | 415/174.1 |

FOREIGN PATENT DOCUMENTS

| | | | |
|---|---|---|---|
| 299035 | 6/1954 | Switzerland | 415/178 |
| 2047354 | 11/1980 | United Kingdom . | |
| 2117451 | 10/1983 | United Kingdom . | |

OTHER PUBLICATIONS

GE Aircraft Engines, "Stage 1 Turbine Shroud Support" from CT7 gas turbine engine, single page excerpt from shop manual, on sale in U.S. for more than one year.

*Primary Examiner*—Edward K. Look
*Assistant Examiner*—Mark Sgantzos
*Attorney, Agent, or Firm*—Jerome C. Squillaro; Nathan D. Herkamp

[57] ABSTRACT

A shroud support includes an annular casing and an annular hanger spaced radially inwardly therefrom. The hanger includes a circumferentially extending flow duct therein and a base for radially supporting a shroud positionable radially over a plurality of circumferentially spaced turbine blades. The hanger is cooled by channeling a cooling fluid circumferentially inside the hanger flow duct for providing more uniform circumferential blade tip clearance and for better matching the thermal movement between the shroud and blade tips.

13 Claims, 5 Drawing Sheets

COOLED SHROUD SUPPORT

The U.S. Government has rights in this invention pursuant to Contract No. DAAE07-84-C-R083 awarded by the Department of the Army.

TECHNICAL FIELD

The present invention relates generally to gas turbine engine blade tip-to-shroud clearance control, and, more specifically, to a cooled shroud support for obtaining improved clearance control.

BACKGROUND ART

A conventional gas turbine engine includes a turbine having a plurality of circumferentially spaced rotor blades with tips thereof spaced radially inwardly from a stationary annular shroud for defining a clearance therebetween. The blade tip clearance should be as small as possible for minimizing leakage of combustion gases around the blades for obtaining improved efficiency of the turbine. However, the operating blade tip clearance must be large enough to accommodate differential thermal expansion and contraction between the rotor blades and the shroud to prevent undesirable rubs therebetween.

The blade tip clearance conventionally has different values at the different steady state operating conditions of the engine, and also has varying values during the various transient operating conditions of the engine which occur as the engine output power levels are varied. Transient blade tip clearance control is a significant concern since the differential thermal movement between the blade tip and the shroud typically has a minimum value, also referred to as a pinch point value which should be suitably large for reducing the possibility of blade tip rubs. However, with a suitably large pinch point, the blade tip clearance occurring at other times in the transient response, as well as during the steady state operation, is necessarily larger than the pinch point and, therefore, allows increased leakage of the combustion gases over the blade tips which decreases turbine performance.

Furthermore, although a gas turbine engine is typically axisymmetric, the temperatures in the environment of the turbine shroud are not necessarily uniform circumferentially about the engine centerline axis. For example, in one exemplary gas turbine engine including a recuperator, compressor discharge air is heated by the recuperator and channeled to the combustor through two circumferentially spaced recuperator conduits disposed near the top and bottom of the engine casing adjacent to the shroud of the high pressure turbine (HPT). Accordingly, the HPT shroud is positioned in an environment wherein the temperature varies substantially circumferentially, with relatively high temperature near the recuperator conduits and relatively low temperature therebetween. The blade tip clearance of the HPT, therefore, might vary circumferentially about the engine centerline axis for conventionally cooled shroud supports providing circumferentially uniform cooling air to the shroud. Accordingly, one object of the present invention is to provide a shroud support having more uniform circumferential cooling thereof for reducing circumferential variations in blade tip clearance.

DISCLOSURE OF INVENTION

A shroud support includes an annular casing and an annular hanger spaced radially inwardly therefrom. The hanger includes a circumferentially extending flow duct therein and a base for radially supporting a shroud positionable radially over a plurality of circumferentially spaced turbine blades. The hanger is cooled by channeling a cooling fluid circumferentially inside the hanger flow duct for providing more uniform circumferential blade tip clearance and for better matching the thermal movement between the shroud and blade tips.

BRIEF DESCRIPTION OF DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawing in which:

MODE(S) FOR CARRYING OUT THE INVENTION

Figure 1:
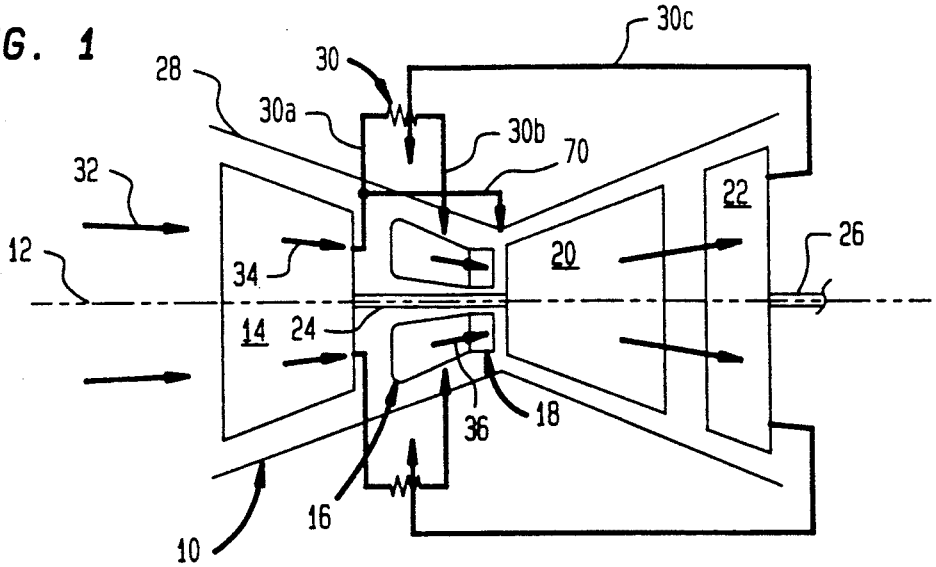
FIG. 1 is a longitudinal, schematic sectional view of an exemplary recuperated gas turbine engine including a turbine shroud support in accordance with one embodiment of the present invention.

Illustrated in FIG. 1 is a schematic representation of an exemplary gas turbine engine 10. The engine 10 includes in serial flow communication and coaxially disposed about an engine axial centerline axis 12, a conventional compressor 14, annular combustor 16, high pressure (HP) turbine nozzle 18, high pressure turbine (HPT) 20, and low pressure turbine (LPT) 22. A conventional HPT shaft 24 fixedly joins the compressor 14 to the HPT 20, and a conventional LPT shaft 26 extends from the LPT 22 for powering a load (not shown).

The engine 10 further includes an annular casing 28 which extends over the compressor 14 and downstream therefrom and over the LPT 22. A conventional recuperator, or heat exchanger, 30 is disposed between the compressor 14 and the LPT 22 outside the casing 28.

Figure 2:
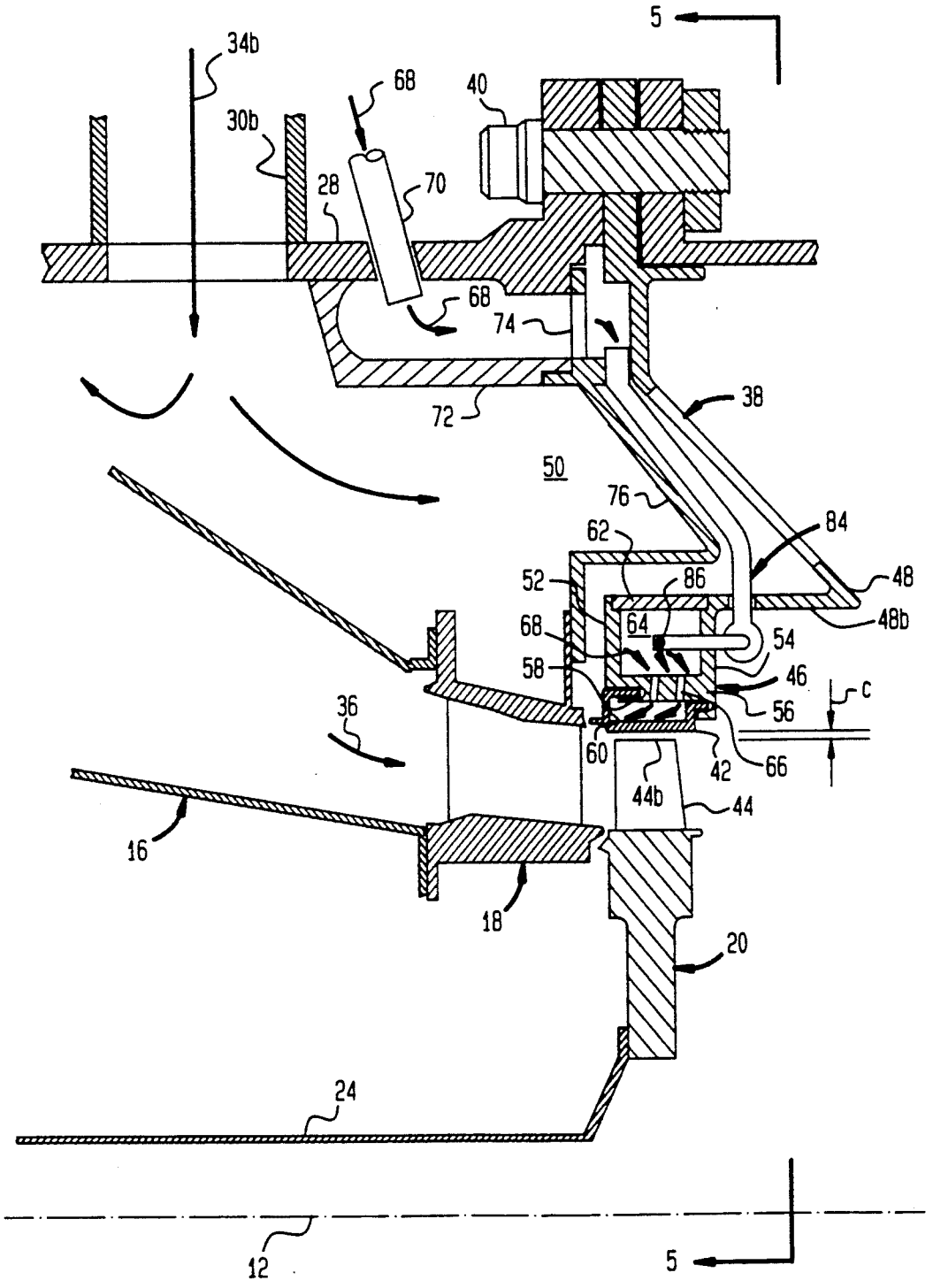
FIG. 2 is an enlarged longitudinal sectional view of the turbine shroud support for the engine illustrated in FIG. 1 in accordance with one embodiment of the present invention.

In conventional operation of the engine 10, ambient air 32 is received by the compressor 14 and compressed for generating compressed airflow 34. The compressed airflow 34 is conventionally channeled through suitable conduits 30*a* through the recuperator 30 wherein it is further heated and then channeled through suitable conduits 30*b* through the casing 28 and adjacent to the combustor 16. The heated compressed airflow 34, designated recuperator airflow 34*b* as shown in FIG. 2, is then conventionally mixed with fuel and ignited in the combustor 16 for generating combustion gases 36 which are channeled through the nozzle 18 and into the HPT 20. The HPT 20 extracts energy from the combustion gases 36 for driving the compressor 14 through the HPT shaft 24, and then the combustion gases 36 are channeled to the LPT 22. The LPT 22 in turn further extracts energy from the combustion gases 36 for driving the load (not shown) joined to the LPT shaft 26. The recuperator 30 is conventionally joined to the LPT 22 by conduits 30*c* for channeling a portion of the combustion gases 36 from the LPT 22 into the recuperator 30 for heating the compressed airflow 34 flowing therethrough.

As shown in FIG. 1, there are two recuperator conduits 30*b* joined to the casing 28 at angular positions about 180° apart. During operation of the engine 10, the heated recuperated airflow 34*b* is channeled through both conduits 30*b* inside the casing 28 adjacent to the combustor 16, HP nozzle 18, and the upstream end of the HPT 20. Since the two conduits 30*b* are spaced 180° apart, the temperature inside the casing 28 varies circumferentially with maximum temperatures adjacent to the two conduits 30*b* and minimum temperatures occurring generally equiangularly or equidistantly therebetween.

Accordingly, this circumferential variation in environment temperature inside the casing 28 adjacent to the HPT 20 will require a suitable shroud support for reducing both differential thermal response of the rotor blades 44 and the shroud 42 and circumferential variation in blade tip clearance as provided by the present invention.

More specifically, and as illustrated in FIG. 2, the engine 10 further includes in accordance with one embodiment of the present invention, a turbine shroud support 38 conventionally fixedly supported to the casing 28 by a plurality of circumferentially spaced bolts 40. A conventional annular turbine shroud 42, in the exemplary form of a plurality of circumferentially spaced shroud segments, is conventionally joined to the shroud support 38 and predeterminedly radially spaced from a plurality of rotor blades 44 of a first stage of the HPT 20. Each of the blades 44 includes a blade tip 44*b* spaced radially inwardly from the shroud 42 to define a blade tip clearance C.

The shroud support 38 includes an annular hanger 46 disposed coaxially about the centerline axis 12, which is also the centerline axis of the shroud support 38. The hanger 46 is fixedly joined to the casing 28 by an integral annular mounting flange 48 in the general form of a truncated cone, which spaces the hanger 46 radially inwardly from the casing 28 in an annular flow channel 50, defined between the casing 28 and the several components spaced radially inwardly therefrom, which receives a portion of the recuperator airflow 34*b*. In the exemplary embodiment of the invention illustrated in FIG. 2, the hanger 46 is generally rectangular in transverse section and includes axially spaced forward and aft annular rails 52 and 54, respectively, extending radially outwardly from an annular base 56. The base 56 includes an axially spaced pair of circumferentially extending conventional outer hooks 58 which conventionally join with complementary inner hooks 60 of the shroud 42 for radially supporting the shroud 42 to the hanger 46.

The hanger 46 also includes an axially extending annular top 62 disposed generally parallel to the base 56 to define therebetween a circumferentially extending flow duct 64 disposed coaxially about the centerline axis 12. The forward and aft rails 52 and 54 and the base 56 are preferably formed integrally with each other, and the top 62 may be suitably fixedly joined thereto, by brazing for example, for forming the enclosed or sealed flow duct 64. The base 56 includes a plurality of circumferentially spaced discharge holes 66 for channeling a cooling fluid 68 from the flow duct 64 to impinge against the shroud 42 for the cooling thereof.

In one embodiment, the cooling fluid 68 is a portion of the compressed airflow 34 discharged from the compressor 14 prior to being heated in the recuperator 30. Referring again to FIG. 1, a conventional supply conduit 70 is suitably provided in flow communication with the outlet of the compressor 14 for receiving a portion of the compressed airflow 34 and for discharging the compressed airflow 34 as the cooling fluid 68 through the casing 28 adjacent to the shroud support 38. Referring again to FIG. 2, the supply conduit 70 extends through the casing 28 and is conventionally joined thereto for providing the cooling fluid 68 into an arcuate manifold 72 having a manifold outlet 74 facing in a downstream direction. In one embodiment built and tested, cooling fluid 68 was simply channeled between the mounting flange 48 and an annular mounting flange 76, which supports the HP nozzle to the casing 28, to a reference hanger substantially identical to the hanger 46, except that no top 62 was provided, for cooling the hanger 46, designated 46*b* in FIG. 3. The cooling fluid entered the reference hanger 46*b* generally radially inwardly along the entire circumference thereof and cooled the reference hanger 46*b* by simple convection cooling.

Figure 3:
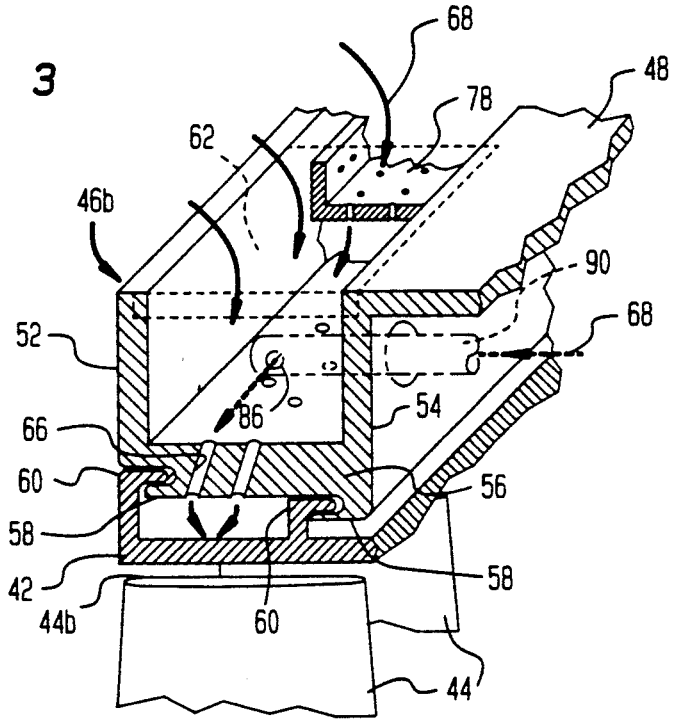
FIG. 3 is a perspective view of a portion of the shroud support hanger illustrated in FIG. 2, in phantom, compared with a non-enclosed hanger of an exemplary reference shroud support.

In another reference hanger embodiment, a U-shaped impingement baffle 78, as also shown in FIG. 3, was considered for channeling the cooling air 68 radially inwardly therethrough for impingement cooling the hanger 46*b*.

Figure 4:
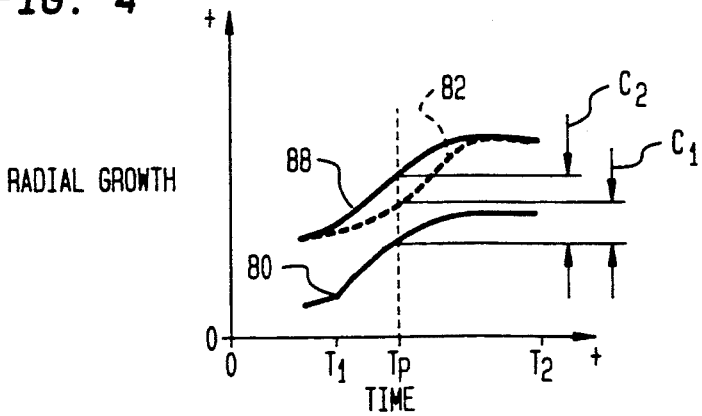
FIG. 4 is a graph plotting radial growth versus time for the shroud support illustrated in FIG. 2 and for the exemplary reference shroud support relative to a rotor.

FIG. 4 is an exemplary graph plotting radial growth versus time and shows the radial growth measured at the blade tips 44*b* as represented by the rotor curve 80 for an exemplary transient response in a burst condition from low to high power from a first time $T_1$ to a second time $T_2$. The corresponding radial growth measured at the inner surface of the shroud 42 for the reference hanger 46*b* illustrated in FIG. 3, without the impingement baffle 78, is represented by the reference shroud curve 82 shown in dashed line in FIG. 4, which radial growth is due primarily to thermal movement of the hanger supporting the shroud. A pinch point of minimum differential radial clearance $C_1$ between the shroud 42 and the blade tips 44*b* is shown at the pinch point time $T_p$. The pinch point clearance $C_1$ occurs in this exemplary embodiment of the engine 10 because the blades 44 on their rotor are expanding faster than the shroud 42, with the rotor time constant $\tau_r$ of the rotor blades 44 being less than the shroud support time constant $\tau_s$ of the shroud support 38. In other words, the shroud support 38 is relatively slow in responding thermally as compared to the rotor blades 44.

The thermal time constant $\tau$ may be represented as follows:

$$\tau = \frac{MC_p}{hA}$$

wherein:

m = mass of the shroud support being cooled which may be represented, for example, by the mass of the hanger 46 being cooled;

$C_p$ = specific heat of the cooling fluid or air 68;

A = area being subject to the cooling fluid 68, for example the inner surfaces of the forward and aft rails 52 and 54 and the base 56; and h = heat transfer coefficient.

The time constant $\tau$ represents, for example, the amount of time it takes to reach about 62% of a new steady state radial position of the blade tips **44*b* and the shroud 42** from the start of a transient occurrence.

In accordance with an object of the present invention, improved matching of the thermal expansion response at the blade tips **44*b* and the shroud 42 supported by the hanger 46 is desired, and which may be obtained by decreasing the time constant $\tau_s$ of the shroud support 38 relative to the time constant $\tau_r$ of the rotor and blades 44. The heat transfer coefficient h for impingement cooling from the baffle 78** is conventionally on the order of about 1,000 BTU/HR-FT$^2$-°F. and significantly affects the time constant as compared to the small affects thereto provided by m, $C_p$, and A. Accordingly, practical changes in the values of m and A have little affect on the time constant $\tau_s$ which is overly sensitive to changes in the heat transfer coefficient h. And, designing for both transient, as well as steady-state, operation is more difficult with impingement cooling.

The heat transfer coefficient h obtained by channeling the cooling fluid 68 radially into the reference hanger **46*b* as shown in FIG. 3, without the baffle 78, was in the range of about 4–8 BTU/HR-FT$^2$-°F., which resulted in the reference shroud curve 82 shown in FIG. 4. However, the difference in time constants between the shroud 42 and the blades 44 still resulted in a relatively small blade tip clearance pinch point during transient operation. And, relatively large circumferential variations in temperature of the forward and aft rails 52 and 54 were observed due to the affects of the introduced recuperator airflow 34*b***.

In accordance with an object of the present invention, the hanger 46 illustrated in FIG. 2 preferably includes the top 62 for creating the enclosed flow duct 64 for obtaining conventionally known pipe or duct flow of the cooling fluid 68 therein. Neither the impingement-cooled nor the convectively cooled open-top reference hanger **46*b* is desired or used so that a heat transfer coefficient h less than that for the former and greater than that for the latter may be used for more accurately controlling the time constant $\tau_s$ of the shroud 42 due to the hanger 46 for better matching the thermal response between the shroud 42 and the blade tips 44*b***.

By enclosing the hanger 46 as illustrated in FIG. 2 with the top 62 and by providing means 84 for cooling the hanger 46 by channeling the cooling fluid 68 circumferentially inside the hanger flow duct 64, the conventionally known pipe or duct flow is effected in the flow duct 64 and may be effectively used in accordance with the present invention for better matching the time constants between the hanger 46 and the blades 44 for providing, among other benefits, a better controlled, e.g., increased blade tip clearance pinch point during transient response.

Figure 5:
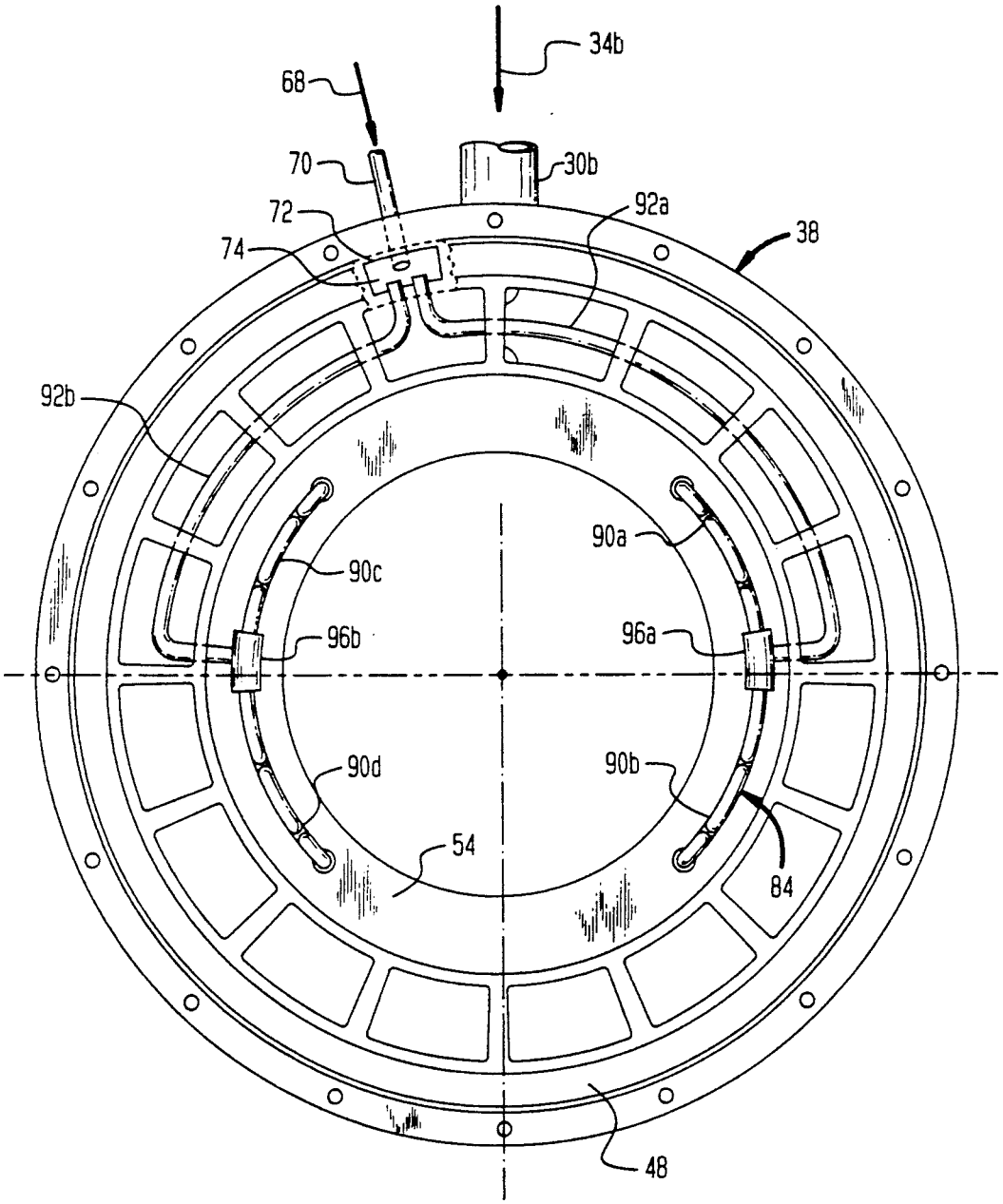
FIG. 5 is a transverse, upstream facing view of the shroud support illustrated in FIG. 2 taken along line 5—5.
Figure 6:
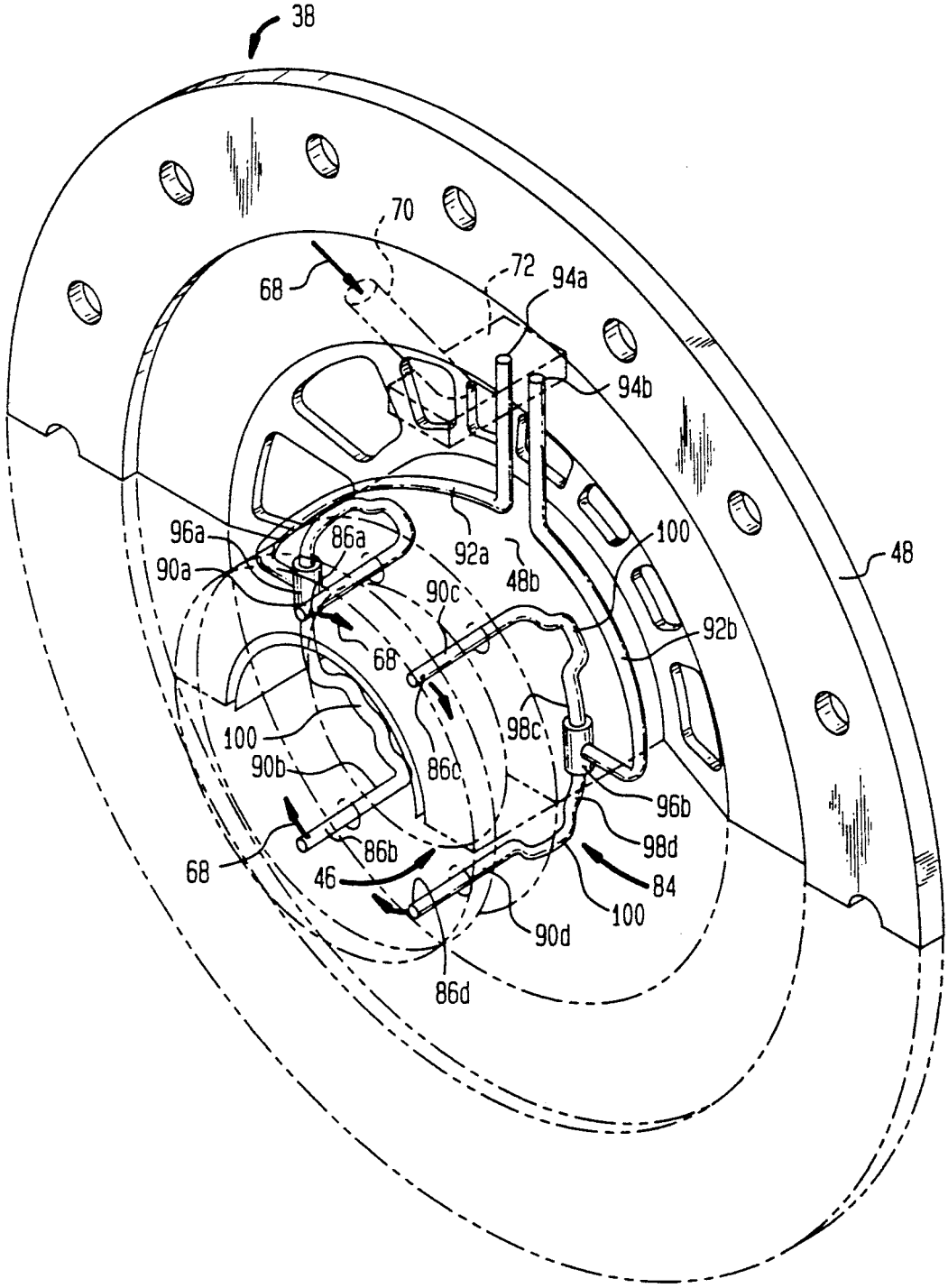
FIG. 6 is an aft facing perspective view of the shroud support illustrated in FIG. 2 shown partly in phantom.

More specifically, and in accordance with one embodiment of the present invention, the cooling means 84 as illustrated, for example, in FIGS. 2, 5, and 6 include a plurality of circumferentially spaced cooling fluid outlets 86, e.g. first, second, third, and fourth fluid outlets **86*a*, 86*b*, 86*c*, and 86*d*, suitably disposed inside the hanger duct 64 and all facing in only one circumferential direction (clockwise as shown in FIG. 6) for discharging the cooling fluid 68 circumferentially inside the duct 64 for obtaining unidirectional pipe flow for which the time constant $\tau_s$ of the hanger 46 may be reduced to more accurately match the time constant $\tau_r$ of the rotor and blades 44. In one embodiment of the hanger 46 built and tested, including the cooling means 84, an improved shroud curve designated 88 as shown in FIG. 4 was obtained which better matches the rotor curve 80 and has an increase in the blade tip clearance pinch point designated $C_2$ at the same pinch point time $T_p$. The time constant $\tau_s$ due to the hanger 46 better matches the time constant $\tau_r$ of the blades 44 as shown by the more uniform spacing between the shroud curve 88 and the rotor curve 80 illustrated in FIG. 4**.

Referring again to FIGS. 5 and 6, the fluid outlets 86 may be simple orifices and are preferably equidistantly spaced from each other, for example, by being equiangularly spaced from each other at a common radius from the centerline axis 12, for obtaining a generally uniform circumferential velocity of the cooling fluid 68 inside the flow duct 64. Although it is contemplated that one or more fluid outlets 86 may be used, at least two fluid outlets 86 are preferred and would be spaced about 180° apart for obtaining generally symmetrical velocity distributions of the fluid 68 as it flows from one of the outlets 86 through the flow duct 64 to the other of the outlets 86. Of course, the more outlets 86 provided in the flow duct 64 the more uniform will be the circumferential velocity of the fluid 68 since the mass flow rate of the fluid 68 will decrease correspondingly smaller from one outlet 86 to the next succeeding outlet 86.

Since the time constant $\tau$ is inversely proportional to the heat transfer coefficient h, and the coefficient h is directly proportional to velocity of the cooling fluid 68, as is conventionally known, the circumferential placement of the outlets 86 may be predeterminedly selected for providing varying degrees of cooling of the hanger 46 depending upon the circumferential variation in temperature of the environment of the hanger 46 due to the circumferentially varying temperature of the recuperator airflow **34*b* being channeled adjacent thereto. Furthermore, by channeling the cooling fluid 68 circumferentially through the flow duct 64, instead of radially into the flow duct 64 around the entire circumference thereof as would occur in the embodiment of the reference hanger 46*b* illustrated in FIG. 3**, a relatively larger heat transfer coefficient h may be obtained.

For example, a heat transfer analysis of the hanger 46 illustrated in FIG. 2 estimates a heat transfer coefficient h of about 40 BTU/HR-FT$^2$-°F. as compared to a smaller heat transfer coefficient h of about 4–8 BTU/HR-FT$^2$-°F. for the reference hanger **46*b* illustrated in FIG. 3 without the use of the impingement baffle 78. The improved heat transfer coefficient h is effective for substantially decreasing the time constant $\tau_s$ due to the hanger 46 for better matching the time constant $\tau_r$ of the blades 44 and for reducing circumferential variations in the temperature of the hanger 46**, which correspondingly is effective for reducing circumferential variations in the blade tip clearance C.

In order to feed each of the four fluid outlets 86, the cooling means 84, as shown in FIGS. 2, 5 and 6, further include a respective plurality of outlet tubes 90, e.g. first, second, third, and fourth outlet tubes 90*a*, 90*b*, 90*c* and 90*d*. Each of the outlet tubes 90 includes a respective one of the fluid outlets 86 disposed in an otherwise closed distal end thereof inside the hanger duct 64 and all facing in the same circumferential direction. The outlet tubes 90 are preferably configured to extend generally axially from inside the flow duct 64 in an aft direction through the aft rail 54 and then each curves for extending circumferentially along a cylindrical portion 48*b* of the mounting flange 48 and coaxially about the centerline axis 12.

Figure 7:
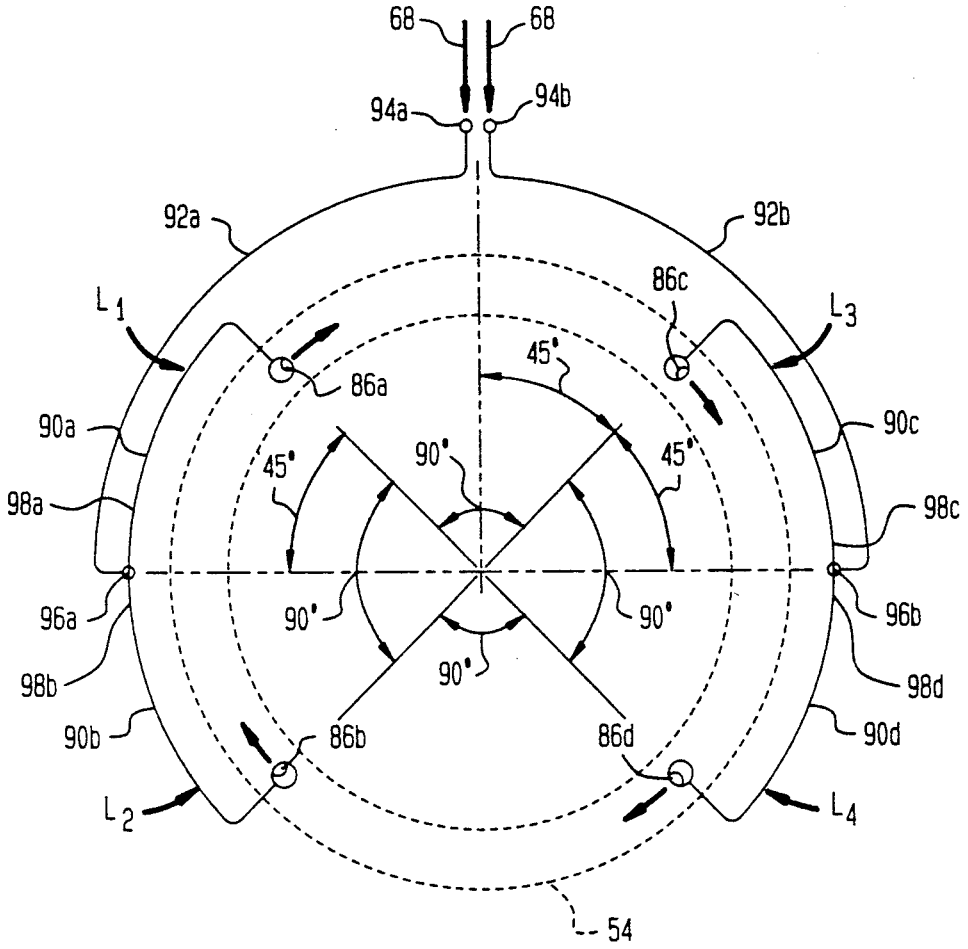
FIG. 7 is a transverse view of the shroud support illustrated in FIG. 2 showing schematically the relative positions of outlet and supply tubes therein.

The cooling means 84 further include a plurality of supply tubes 92, e.g. first and second supply tubes 92*a* and 92*b*, each being effective for channeling the cooling fluid 68 to a respective pair of the outlet tubes 90. As shown in FIGS. 6 and 7, each of the supply tubes 92 includes a respective inlet 94*a*, 94*b* disposed adjacent to each other in flow communication with the outlet 74 of the common manifold 72 for receiving the cooling fluid 68 therefrom. The supply tubes 92 each include a respective outlet 96*a*, 96*b*, each of which is disposed in fluid communication with a respective pair of inlets 98 at proximal ends of the tubes 90, i.e. first and second outlet tube inlets 98*a* and 98*b* being joined to the first supply tube outlet 96*a*; and second and third tube inlets 98*c* and 98*d* being joined to the second supply tube outlet 96*b*. Each of the supply tubes 92 is preferably configured to extend generally radially outwardly from its respective outlet tubes 90 through the mounting flange cylindrical portion 48*b* and then extends circumferentially generally coaxially about the centerline axis 12 for an arcuate distance and then bends radially upwardly adjacent to a corresponding portion of the adjacent supply tube 92 for positioning the supply tube inlets 94*a* and 94*b* in fluid communication with the manifold 72.

The above described configuration of the outlet tubes 90 and the supply tubes 92 is preferred for suitably channeling the cooling fluid 68 from the common manifold 72 to the four circumferentially spaced fluid outlets 86. The tubes 90 and 92 are preferred firstly for providing a more direct path for channeling the cooling fluid 68 to the flow duct 64 for reducing the indirect heating of the cooling fluid 68 by the recuperator airflow 34*b*. In this way, the relatively cool compressed airflow 34 may be provided as the cooling fluid 68 to the flow duct 64 with relatively little increase in temperature due to heat pick-up along the travel thereof, and without leakage of the cooling fluid 68 from its travel to the hanger 46.

Furthermore, it is desirable also to provide the cooling fluid 68 at a predetermined temperature at each of the four fluid outlets 86, which in accordance with one embodiment of the present invention is at substantially uniform temperatures. Accordingly, each of the four flowpaths from respective ones of the supply tube inlets 94*a*, 94*b* at the manifold 72 to respective ones of the four fluid outlets 86 through the outlet and supply tubes 90 and 92 preferably has a flowpath length i.e. first, second, third and fourth flowpath lengths $L_1$, $L_2$, $L_3$, and $L_4$, which are substantially equal to each other.

FIG. 7 illustrates schematically the outlet and supply tubes 90 and 92 for channeling the cooling fluid 68 from the inlets 94*a*, 94*b* to the respective fluid outlets 86*a*, 86*b*, 86*c*, and 86*d*. The four flowpath lengths $L_1$, $L_2$, $L_3$, and $L_4$ are also illustrated. The supply tubes 92 and the outlet tubes 90 are predeterminedly sized and configured for obtaining, in this exemplary embodiment, substantially uniform temperature of the cooling fluid 68 discharged from the four outlets 86. Since the outlet and supply tubes 90 and 92 are disposed inside the channel 50 (as shown in FIG. 2) they are subject to being heated by the recuperator airflow 34*b*. However, the tubes 90, 92 are shielded from direct exposure to the recuperator airflow 34*b* by the flange 76. And, by providing substantially equal flowpath lengths $L_1$–$L_4$, the amount of heat pick-up in the cooling fluid 68 channeled through the tubes 90 and 92 will be generally equal for ensuring that the cooling fluid 68 is discharged from the outlets 86 at a common temperature. In this way, thermal expansion and contraction of the hanger 46 due to the cooling fluid 68 channeled through the duct 64 may be relatively uniform for decreasing circumferential distortions and any attendant circumferential variations in the blade tip clearance C.

As shown schematically in FIG. 7, in order to obtain the equal flowpath lengths $L_1$–$L_4$ in this exemplary embodiment, the four fluid outlets 86 are circumferentially spaced from each other at about 90°, and the supply tube outlets 96*a* and 96*b* are preferably spaced from each other at about 180° and spaced between respective ones of the fluid outlets 86 at about 45°. Furthermore, the first and second supply tube inlets 94*a* and 94*b* are circumferentially spaced from respective ones of the supply tube outlets 96*a* and 96*b* at about 90°. The first and second outlet tubes 90*a* and 90*b*are also preferably spaced circumferentially away and oppositely from the third and fourth outlet tubes 90*c* and 90*d* so that the first and second supply tubes 92*a* and 92*b* and the respective outlet tubes connected thereto do not overlap each other.

Figure 8:
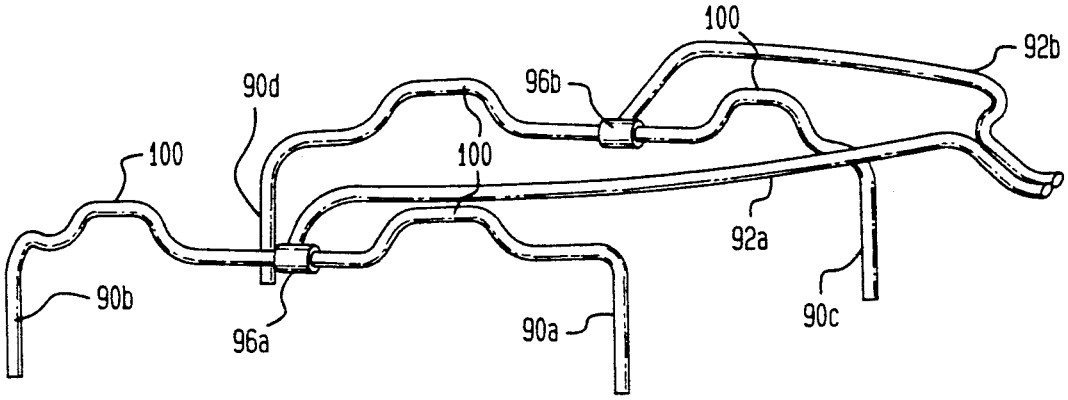
FIG. 8 is a perspective, schematic view of the outlet and supply tubes illustrated in FIG. 7.

Furthermore, by configuring portions of the outlet and supply tubes 90 and 92 circumferentially around the centerline axis 12, thermal expansion and contraction thereof may be accommodated for reducing thermally induced stress therein. In order to additionally reduce thermal stress in the outlet tubes 90 due to thermal expansion and contraction, each of the outlet tubes 90 preferably includes a generally U-shaped jog 100 extending in the axial direction in the circumferentially extending portion thereof adjacent to the mounting flange cylindrical portion 48*b*. The jogs 100 are illustrated in FIG. 6, and also in FIG. 8 which shows a perspective view of the outlet and supply tubes 90 and 92 removed from the shroud support 38.

The improved turbine shroud support 38 disclosed above is, accordingly, more effective for better matching the time constant for the radial movement of the rotor blades 44 with that of the shroud 42 due to the hanger 46 and for effectively increasing the blade tip clearance pinch point during transient operation. Furthermore, circumferential variations in temperature of the hanger 46 are also reduced, thusly improving roundness of the hanger 46 and reducing the corresponding circumferential variations in blade tip clearance C. The improved cooling effectiveness due to the shroud support 38 in accordance with the present invention is also effective for decreasing differential temperature between the forward and aft rails 52 and 54, which also decreases the corresponding variations in blade tip clearance C due to differential radial movement between the forward and aft rails 52 and 54.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

I claim:

1. A shroud support having a longitudinal centerline axis comprising:

an annular casing;

an annular hanger fixedly joined to said casing and spaced radially inwardly therefrom to define an annular channel therebetween, said hanger being disposed coaxially about said centerline axis and having a base for radially supporting a shroud positionable radially over a plurality of circumferentially spaced turbine blades, and a circumferentially extending flow duct extending radially outwardly from said base and toward said annular channel; and means for cooling said hanger by channeling a cooling fluid circumferentially inside said hangers duct for obtaining unidirectional circumferential flow therein.

2. A shroud support according to claim 1 wherein said hanger cooling means comprise a plurality of circumferentially spaced cooling fluid outlets disposed inside said hanger duct and facing in one circumferential direction for discharging said cooling fluid circumferentially inside said duct.

3. A shroud support according to claim 2 wherein said fluid outlets are equidistantly spaced from each other.

4. A shroud support according to claim 2 wherein said hanger cooling means further comprise a plurality of outlet tubes each having a respective one of said fluid outlets disposed in a distal end thereof inside said hanger duct, said outlet tubes being predeterminedly sized and configured for obtaining substantially uniform temperature of said cooling fluid dischargeable from said plurality of fluid outlets.

5. A shroud support according to claim 4 wherein said hanger cooling means further comprise a plurality of supply tubes, each for channeling said cooling fluid to a respective pair of said outlet tubes, said supply tubes being predeterminedly sized and configured with said outlet tubes for obtaining substantially uniform temperature of said cooling fluid dischargeable from said plurality of fluid outlets.

6. A shroud support according to claim 5 further including four of said fluid outlets and said respective outlet tubes, and two of said supply tubes, each of said supply tubes having an inlet for receiving said cooling fluid, and wherein each of four flowpaths from a respective one of said two supply tube inlets to a respective one of said four fluid outlets through said supply and outlet tubes has a flowpath length, said four flowpath lengths being substantially equal to each other.

7. A shroud support according to claim 6 wherein:

said four fluid outlets are equiangularly spaced from each other;

first and second ones of said outlet tubes extend generally coaxially about said centerline axis and have inlets joined to an outlet of a first one of said supply tubes;

third and fourth ones of said outlet tubes extend generally coaxially about said centerline axis and have inlets joined to an outlet of a second one of said supply tubes; and said first and second outlet tubes are spaced circumferentially oppositely from said third and fourth outlet tubes.

8. A shroud support according to claim 7 wherein said first and second supply tubes extend generally coaxially about said centerline axis, and said inlets thereof are disposed adjacent to each other for receiving said cooling fluid from a common manifold.

9. A shroud support according to claim 8 wherein:

said four fluid outlets are circumferentially spaced from each other at about 90°;

said first and second supply tube outlets are spaced from each other at about 180 ° and spaced between respective ones of said fluid outlets at about 45°; and said first and second supply tube inlets are spaced from respective ones of said first and second supply tube outlets at about 90°.

10. A shroud support according to claim 9 wherein said hanger is generally rectangular in transverse section and includes axially spaced forward and aft rails extending radially outwardly from said base, and an axially extending top disposed generally parallel to said base to define therebetween said flow duct.

11. A shroud support according to claim 10 wherein said base includes a plurality of circumferentially spaced discharge holes for channeling said fluid from said flow duct to impinge against said shroud.

12. A shroud support according to claim 9 wherein each of said outlet tubes includes a jog for accommodating thermal movement of said outlet tube.

13. A shroud support according to claim 2 wherein said hanger is generally rectangular in transverse section and includes axially spaced forward and aft rails extending radially outwardly from said base, and an axially extending top disposed generally parallel to said base to define therebetween said flow duct.

* * * * *